US005230589A

United States Patent [19]

Gillespie

[11] Patent Number: 5,230,589

[45] Date of Patent: Jul. 27, 1993

[54] MINE ROOF BOLT

[76] Inventor: Harvey D. Gillespie, 4848 S. 2200 West, Salt Lake City, Utah 84118

[21] Appl. No.: 856,371

[22] Filed: Mar. 23, 1992

[51] Int. Cl.[5] ..... E21D 21/00; E21D 20/02

[52] U.S. Cl. ..... 405/259.6; 405/259.1; 405/259.5

[58] Field of Search ..... 405/259.1-259.6, 405/303

[56] References Cited

U.S. PATENT DOCUMENTS

| | | | |
|---|---|---|---|
| 2,850,937 | 9/1958 | Ralston | 405/259.1 X |
| 3,650,112 | 3/1972 | Howlett et al. | 405/259.5 |
| 4,140,428 | 2/1979 | McLain et al. | 405/259.6 |
| 4,449,855 | 5/1984 | Langwadt | 405/259.5 |
| 4,648,753 | 3/1987 | Stephan | 405/259.6 X |
| 4,798,501 | 1/1989 | Spies | 405/259.1 X |
| 4,832,534 | 5/1989 | Duyieusart | 405/259.6 |
| 4,884,377 | 12/1989 | Matt | 405/259.1 X |

FOREIGN PATENT DOCUMENTS

| | | | |
|---|---|---|---|
| 198482 | 7/1958 | Austria | 405/259.4 |

*Primary Examiner*—Dennis L. Taylor

*Attorney, Agent, or Firm*—Michael D. McCully

[57] ABSTRACT

An improved mine roof bolt is constructed of pre-tensioned, multi-strand steel cable. The bolt head is constructed of a hexagonal-or other drive-headed collar having an internally tapered frusto-conical bore therethrough, and a tapered plug having a frusto-conical outer surface that engages the frusto-conical inner surface of the drive collar. The tapered plug has an internal bore essentially concentric with the outer frusto-conical surface, and is adapted to fit over the multi-stranded steel cable, the hexagonal head drive collar fitting over the tapered plug such that pressing the tapered plug and steel cable into the inner frustoconical bore of the hexagonal-head drive collar causes serrations on the internal bore of the tapered plug to be urged down against, and bite into, the steel cable, resulting in a solid hexagonal head for the cable bolt. The tapered plug is in actuality, a pair of essentially identical diametrically opposed semi-frusto-conical tapered sections that more easily compress together to bite into the multi-strand steel cable. The improved mine roof bolt is intended for use in passive-type mine roof systems.

11 Claims, 3 Drawing Sheets

MINE ROOF BOLT

BACKGROUND OF THE INVENTION

1. Field of the Invention

The present invention relates to mine roof bolts, and more particularly relates to mine roof bolts constructed of pretensioned, multi-strand steel cable.

2. Description of the Prior Art

In the art of mine roof support, there are two major categories of bolt systems wherein mine roof bolts are anchored in bore holes drilled in the mine roof, the bolts' purpose being to reinforce the unsupported rock formation above the mine roof. These two categories of mine roof bolt systems are: (1) tension-type systems, and (2) passive-type systems. In each system, it is common practice to, first, drill a hole through the mine ceiling into the rock formation above to a depth appropriate for the type of rock formation to be supported. A mine roof bolt and roof plate are then anchored in the bore hole to support the mine roof and maintain the rock formation in place.

In tension-type mine roof bolt systems, an expansion shell type anchor is installed on the end of the bolt. The bolt and expansion shell anchor are inserted up into the bore hole until the roof plate is against the mine roof. The bolt is then rotated to thread a tapered plug section of the expansion shell down toward the bolt head, in order to expand the jaws of the expansion shell against the interior wall of the bore hole to thereby hold the mine roof bolt in place within the bore hole.

In passive-type mine roof bolt systems, the passive-type bolt is not attached to an expansion shell or similar device at the free (upper) end of the bolt, but rather is retained in place within the rock formation by a rapid-curing resin material that is mixed in the bore hole as the bolt is rotated and positioned within the bore hole. In theory, the resin bonds the bolt to the rock formation along the total length of the bolt within the bore hole in the rock formation. It is also common practice to use resin with a tensiontype mine roof bolt to retain the bolt within the mine roof bore hole.

In these passive-type mine roof bolt systems, one or more resin cartridges are inserted into the bore hole prior to (ahead of) the mine roof bolt. Forcing the mine roof bolt into the bore hole while simultaneously rotating the bolt ruptures the resin cartridge(s) and mixes the two resin components within the annulus between the bolt shank and bore hole wall. Ideally, the resin mixture totally fills the annulus between the bolt shank and bore hole wall along the total length of the bolt and bore hole. The resin mixture penetrates the bore hole wall and into the surrounding rock formation to adhere the bolt to the rock formation.

When extremely long mine roof bolts are necessary, it is common practice to attach two or more bolt sections together by couplers to result in a "roof bolt" of sufficient length appropriate for the particular type of rock formation. These couplers between bolt sections, being of a larger diameter than the bolt shanks, prevent the mixed resin from flowing downwardly (resin return) within the bore hole annulus from the first (upper) bolt section to the lower section(s). Therefore, the anchoring of the bolt to the bore hole wall within the rock formation is, effectively, only along the length of the first (upper) bolt section wherein the resin totally fills the annulus between the bolt section and the bore hole wall.

To alleviate this problem, it has been common practice simply to drill a larger bore hole in the rock formation that will enable the resin to flow around the coupler(s) as the bolt is being rotated within the bore hole to mix the resin. Although this does effect the desired result (resin return around the coupler(s) within the annulus between the bolt shank and bore hole wall), it creates another problem that, depending on the type of rock formation, may be more dangerous than the problem that is corrected by a larger bore hole. Specifically, the bonding effectiveness of the resin bonding material to hold the mine roof bolt in place within the bore hole is considerably weakened by virtue of the increased distance between the bolt shank and bore hole wall, and the sheer volume of resin material necessary to totally fill the annulus with the resin bonding material. Additionally, by virtue of their specific makeups, mine roof rock formations that actually require long (fifteen feet or longer) mine roof bolts are more susceptible to movement and shifting within the rock formation, than are more solid rock formations that require only shorter mine roof bolts.

Another common problem with using mine roof bolt sections coupled together in such rock formations that require longer (coupled) mine roof bolts, this shifting of the rock formation (shear) causes the bolt couplers to fracture. When this happens, of course, the effective holding length of the mine roof bolt is instantly decreased. In many instances, there is no or very little resin adhesive material around the broken bolt shank to help stabilize the rock formation. Therefore, in almost all instances, this shortened mine roof bolt is ineffective to safely prevent the mine roof rock formation from further shifting and potential collapse.

It is therefore an object of the present invention to provide an improved mine roof bolt that does not require an oversized mine roof bore hole in order to effect full and complete resin return within the annulus between the bolt shank and bore hole wall along the total length of the bolt shank.

It is another object of the present invention to provide an improved mine roof bolt that is available in various lengths without the use of bolt shank couplers that are susceptible to fracture when the mine roof rock formation shifts.

It is a further object of the present invention to provide an improved mine roof bolt having an inherently rough outer surface that aids in effecting complete mixture of the resin bonding material, and also includes crevices within the mine roof bolt shank that permit penetration of the resin bonding material int the bolt shank for more effective resin bonding thereto.

It is a still further object of the present invention to provide an improved mine roof bolt that will easily bend for installation into a bore hole that is considerably deeper than the height of the mine at the installation location, and will also bend with a shifting rock formation, and fully retain its bonding within the rock formation along the total length of the mine roof bolt without breaking when the rock formation shifts.

SUMMARY OF THE INVENTION

The improved mine roof bolt of the present invention is constructed of a length of pre-stressed, multi-strand steel cable, commonly formed of six individual pre-stressed steel strands spirally wrapped around a seventh steel strand. The head of the bolt is formed by positioning a two-piece tapered plug around the stranded steel cable at one end, and then slipping a hexagonal- or other drive-headed internally tapered collar around the tapered plug. Pressing the internally tapered hexagonal head collar down over and against the two-piece tapered plug urges serrations on the interior circumference of the plug sections to "bite" into the stranded steel cable to form a rigid hexagonal bolt head on the cable that further tightens against the steel strands as tension is applied to the mine roof bolt.

DESCRIPTION OF THE PREFERRED EMBODIMENT

Figure 1:
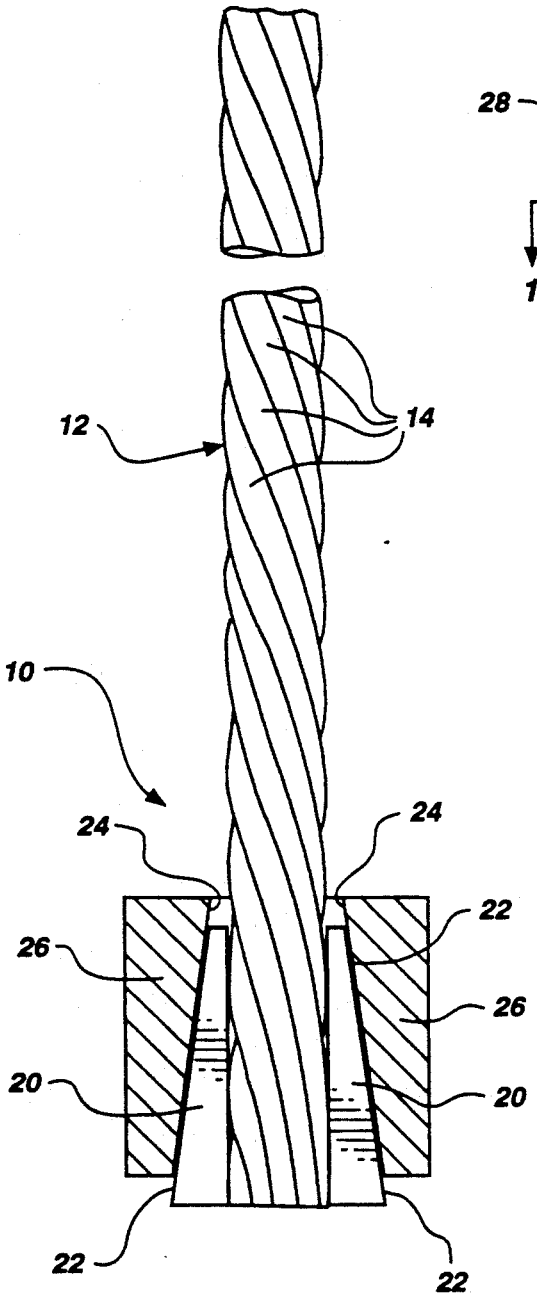
FIG. 1 is a partial conventional view of the improved mine roof bolt of the present invention, illustrating the two-piece tapered plug and, in section, the internally tapered hexagonal head collar.

Referring now to the drawings, and initially to FIG. 1, the improved mine roof bolt is shown, generally illustrated by the numeral 10. The mine roof bolt comprises a shank 12 made up of a length of pre-stressed steel stranded cable, which in the embodiment shown, is made up of six peripheral steel strands 14 spirally wrapped around a central steel strand 16 (more clearly shown in FIG. 2).

At one end of the pre-stressed steel stranded cable is affixed a two-piece tapered plug 20 which comprises two identical diametrically opposed essentially half-cylinders that define the outer surface of a right conical frustum. The frusto-conical outer surface 22 of the two-piece tapered plug 20 is designed to engage a mating inside frusto-conical surface of an internally tapered hexagonal head collar 26. Although the collar 26 is shown as a hexagonal head, obviously a square head or any other shaped head that accepts a mine roof bolt driver mechanism and boom should function adequately for the intended purpose.

Figure 2:
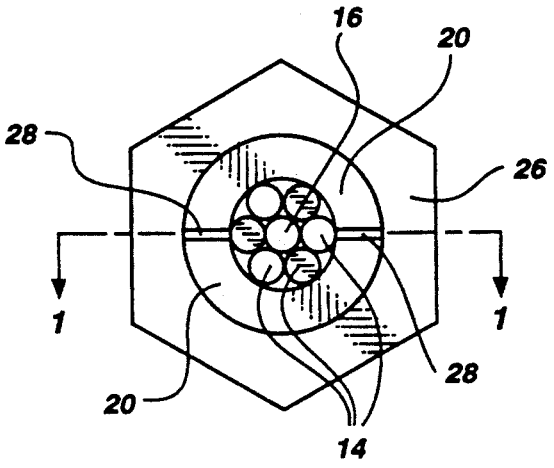
FIG. 2 is an end view of the improved mine roof bolt.

FIG. 2 is an end view of the improved mine roof bolt of the present invention, and illustrates how the two-piece tapered plug fits concentrically around the pre-stressed steel stranded cable shank of the bolt, and also nests concentrically within the internally tapered hexagonal head collar 26. Note that the individual sections of the two-piece tapered plug 20 are not fully semi-frusto-conical. When functionally positioned within the hexagonal head collar 26 and around the pre-stressed steel stranded cable roof bolt shank 12, the two individual plug sections 20 define a diametric space 28 between the two plug sections to enable the plug sections to be urged together slightly when pressed against the pre-stressed steel stranded cable.

Figure 3:
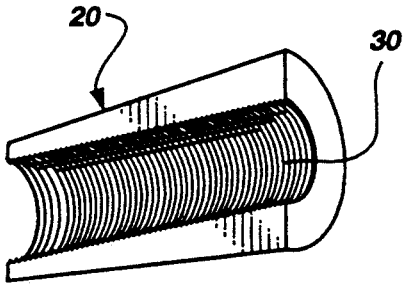
FIG. 3 is a perspective view of one section of a two-piece tapered plug.

FIG. 3 is a perspective view of one section of the two-piece tapered plug 20 and more clearly shows a series of serrations or knurls 30 that define the inner essentially semi-tubular surface of the tapered plug. These serrations 30 are designed to "bite" into the pre-stressed steel stranded cable defining the roof bolt shank 12 as the two-piece tapered plug 20 is urged further into the hexagonal head collar 26 to define a rigid hex-head of the improved mine roof bolt.

Creating this rigid hex-head on the mine roof can be accomplished in either of two ways: (1) By pressing the two-piece tapered plug 20 and pre-stressed steel stranded cable bolt shank 12 into the hexagonal head collar 26 as the mine roof bolt is factory-manufactured; or (2) After having cut the pre-stressed steel stranded cable to the desired length at the mine site, assembling the pre-stressed steel stranded cable, two-piece tapered and hexagonal head collar 26, and then tensioning the pre-stressed steel stranded cable against the hexagonal head collar, or otherwise pressing the tapered plug and cable-into the collar. In either instance, the "head" of the improved mine roof bolt 10 should be rigid and secure enough to remain intact as the mine roof bolt is being inserted into the mine roof bore hole, forced up into the bore hole against the resin capsule, and rotated or spun within the mine roof bore hole in order to rupture the resin capsule and mix and distribute the resin material.

Figure 4:
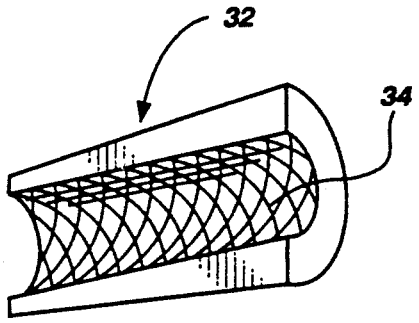
FIG. 4 is a perspective view of an alternative embodiment of one section, of a two-piece tapered plug.

FIG. 4 is a perspective view of one section of an alternative embodiment of a two-piece tapered plug, shown at 32. This alternative embodiment tapered plug includes a different type of knurl 34 formed in a diamond pattern resulting from diagonally oriented serrations. Those skilled in the art will appreciate that this diamond pattern knurl will better retain the tapered plug 32 on the pre-stressed steel stranded cable against both torsion as the improved mine roof bolt 10 is rotated during installation, and against tension as the bolt remains in place within mine roof rock formation to retain the rock formation in place.

Figure 5:
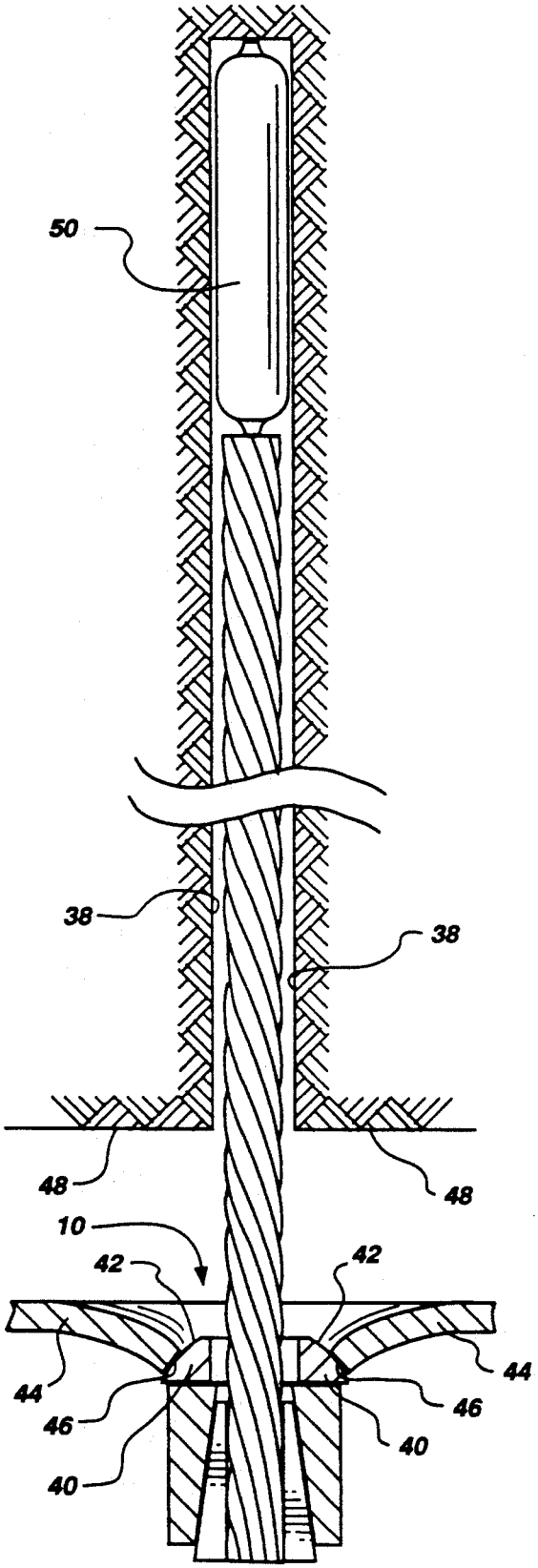
FIG. 5 is a side elevation view of the improved mine roof bolt positioned in the mine roof bore hole under the resin cartridge, the mine roof plate, spherical washer, and internally tapered hexagonal head being shown in section.

FIG. 5 illustrates the improved mine roof bolt and its arrangement as inserted up into a mine roof bore hole. Assuming that the improved mine roof bolt has previously been assemble as shown in FIG. 1, and the two-piece tapered plug 20 pressed into the hexagonal head collar 26 to define a rigid bolt head, the user first places a spherical washer 40 having a partial spherical surface 42 over the bolt shank and down against the hexagonal head collar 26, as shown. Next, the user slips on a dome mine roof plate 44, the through-hole of the roof plate having an angled surface 46 that mates with the partial spherical surface 42 of the spherical washer 40. Those skilled in the art will appreciate that this spherical washer 40 and the angled surface 46 of the dome mine roof plate 44 define "ball and socket"-like arrangement that permits the improved mine roof bolt and dome mine roof plate to be used in mine roofs wherein (1) the bore holes are angled or otherwise not normal to the surface of the mine ceiling 48, (2) the mine ceiling surfaces are extremely rough or otherwise uneven, or (3) a combination of (1) and (2) that results in the entrance to the mine roof bore hole not being exactly normal to the mine ceiling surface at the location of the mine roof bore hole. Additionally, such an arrangement permits the improved mine roof bolt 10 to shift slightly as the rock formation above shifts, and still maintain an essentially uniform force of the dome mine roof plate 44 against the mine ceiling 48.

To this end, the inventor has determined that, alternatively, the hexagonal head 26 of the improved mine roof bolt of the present invention and the spherical washer may be formed as a single piece. This simplifies installation and more easily maintains the mine roof bolt in alignment with the roof plate during rotation of the mine roof bolt in the roof bore hole.

Figure 6:
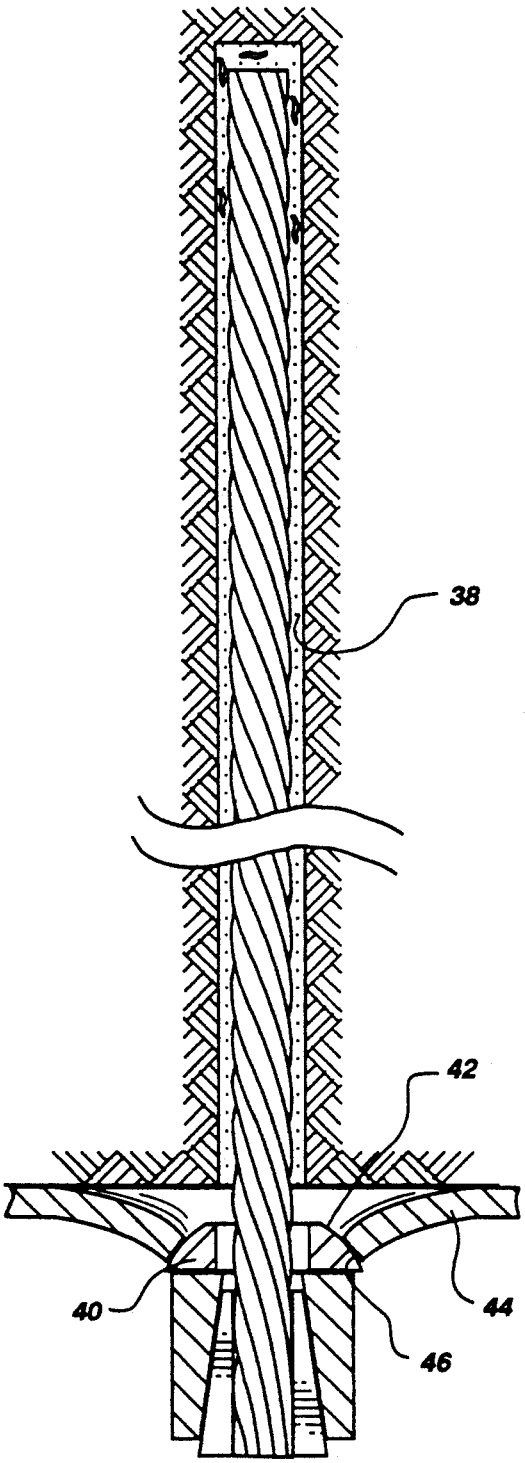
FIG. 6 is a view of the improved mine roof bolt of FIG. 5, shown in installed position within the mine roof bore hole, with the resin material thoroughly mixed and completely filling the annulus around the shank of the mine roof bolt.

The spherical washer 40 and dome mine roof plate 44 having been installed on the improved mine roof bolt 10, the user then inserts a resin cartridge 50 into the mine roof bore hole 38, followed by the improved mine roof bolt of the present invention. The user then forces the improved mine roof bolt 10 upwardly into the mine roof bore hole 38 under the force of the boom (not shown), while simultaneously rotating the mine roof bolt to rupture the resin cartridge 50 and thoroughly mix and distribute the resin material contained therein. Continued rotation of the improved mine roof bolt 10 after the dome mine roof plate 4 has been urged against the mine ceiling 48, further mixes and distributes the resin material within the annulus between the pre-stressed steel stranded cable and the mine roof bore hole 38, and causes the resin material to be forced into the cracks and crevices within the mine roof bore hole 38, and also into the crevices and spaces between the individual peripheral steel strands 14 of the pre-stressed steel stranded cable. After the resin material is thoroughly mixed, the assembled bolt is held in place against the mine ceiling 48, as shown in FIG. 6, by the boom, for a period of time sufficient to permit the resin to cure.

Figure 7:
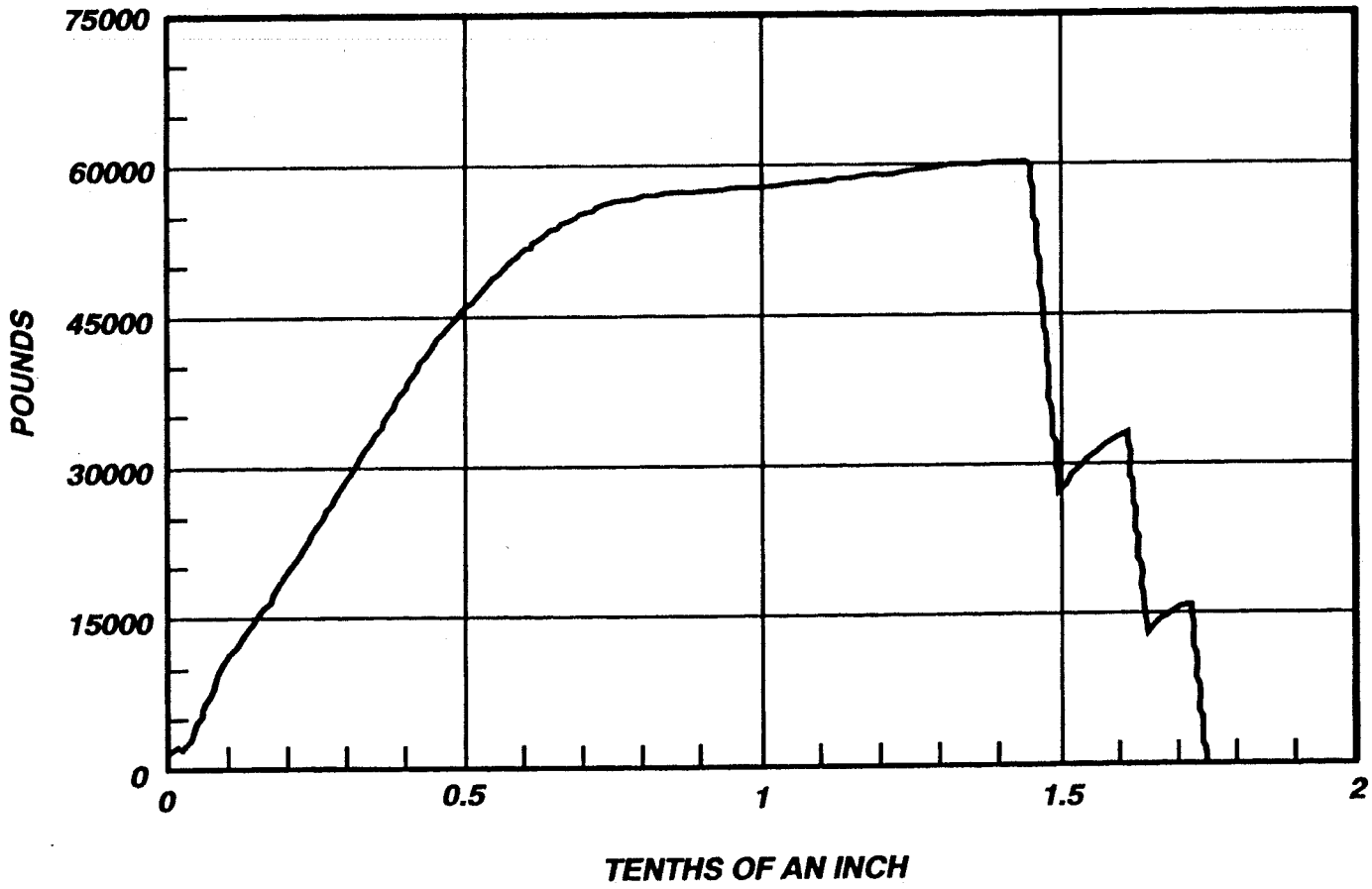
FIG. 7 is a graph of tensile strength vs. elongation for a 9/16 inch diameter improved mine roof bolt of the present invention.

FIG. 7 is a graph of n le strength vs. elongation for a 9/16 inch diameter cable mine roof bolt of the present invention. When pulled in tension until fracture, the improved mine roof bolt begins to yield at approximately 57,000 pounds of force, and will withstand over 60,00 pounds of force before fracturing.

As the graph of FIG. 7 illustrates, the fracture of the seven strand cable mine roof bolt actually occurs in a stepped progression, rather than all at once. Typically, one, two, or three individual cable strands will fail at approximately 60,000 pounds, the remaining four, five, or six strands remaining intact to continue to support the rock formation above the mine roof. These remaining four to six strands will continue to withstand from 25,000 to 35,000 pounds of force before the next set of one, two, or three strands fails in tension. The steel cable strands remaining intact after the second set of strands fails (from one to four) will continue to withstand approximately 15,000 pounds of force before ultimate total failure of the mine roof bolt.

By comparison, a conventional 158 inch diameter smooth shank mine roof bolt will fail at under approximately 30,000 pounds of force, at approximately one-half of the maximum force of approximately 60,000 pounds that a 9/16 inch diameter cable mine roof bolt will withstand before the initial partial failure.

It is important to note that when the 9/16 inch cable mine roof bolt "fails" at 60,000 pounds, its failure is only partial, in that four to six steel strands remain intact through the first "stepped failure". Therefore, the improved mine roof bolt of the present invention remains intact after initial "failure" to continue to support the rock formation to permit the rock formation to stabilize with the mine roof bolt intact and still able to withstand approximately 30,000 pounds of force before a subsequent "failure" occurs.

It should also be noted that the multi-strand cable defining the shank of the improved mine roof bolt of the present invention fractures at the point of attachment to the two-piece tapered plug, leaving the total length of the steel cable shank remaining in the mine roof bolt bore hole to continue to support the rock formation. This is to be contrasted with conventional mine roof bolts formed of shank sections collared together that generally fracture either at the collar or along one of the shaft sections. In the event the collar has prevented complete resin return along the total length of the bolt section(s), that portion of the mine roof bolt below the fracture, if not resin-bonded into the rock formation, is rendered totally ineffective as structural support, and likely will even fall out of the mine roof bore hole.

It is this aspect of the improved mine roof bolt of the present invention that permits it to better withstand rock formation lateral movement, in that the cable mine roof bolt (1) will not fracture along the shank or coupler (there is not coupler), but will fracture at the hexagonal head, and (2) will remain intact along its total length of the shank within the bore hole, even following a partial "stepped fracture".

It should be obvious to those skilled in the art that the improved mine roof bolt of the present invention, not utilizing mine roof bolt shank couplers, does not require an overly large bore hole in the mine roof. Therefore, less potential damage is done to the structural integrity of the rock formation above the mine roof. Additionally, less resin adhesive is required in the bore hole, and the resin that is in the bore hole is more effective, in that the bonding distance between the bolt shank surface and the inside surface of the bore hole wall is considerably smaller. Also, the improved mine roof bolt, not utilizing bolt shank couplers, does not have the problem of bolt or coupler fracture when the mine roof rock formation shifts.

Lastly, the improved mine roof bolt, not utilizing bolt shank couplers and, in addition, having a rough outer surface to the shank, facilitates complete mixture of the resin material and complete distribution of the resin material along the total length of the mine roof bolt shank and mine roof bore hole wall.

Inasmuch as the improved mine roof bolt of the present invention is constructed of a multi-strand cable rather than a solid shank, the mine roof bolt will bend sufficiently to follow the path of an irregular bore hole. The multi-strand, flexible cable mine roof bolt can also be bent to facilitate installation into a bore hole that requires a roof bolt that is considerably longer than the height of the mine at the location of the mine roof bore hole, and will also bend rather than break, when the mine roof rock formation shifts.

From the foregoing it will be seen that this invention is one well adapted to attain all of the ends and objects herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A mine roof bolt comprising:

(a) a length of multi-strand cable defining a bolt shank;

(b) a tapered plug comprising a body portion having an internal bore and a frusto-conical outer surface essentially concentric with said internal bore, said tapered plug being mounted about an end of said cable at said internal bore; and (c) an internally tapered drive collar having a frusto-conical inner surface that engages said frusto-conical outer surface of said tapered plug, and having an outer surface defining a drive head that accepts a driving mechanism for rotating and linearly translating said bolt, wherein said tapered plug is mounted on an end of said cable, and said drive collar is pressed down upon said tapered plug, forcing said tapered plug against said cable, such that said drive collar, said tapered plug, and said cable, when fitted tightly together, define said mine roof bolt.

2. a mine roof bolt as set forth in claim 1, wherein said multi-strand cable comprises a plurality of steel strands spirally wrapped around a central steel strand.

3. A mine roof bolt as set forth in claim 1, wherein said tapered plug comprises two essentially diametrically opposed semifrusto-conical tapered plug sections.

4. A mine roof bolt as set forth in claim 3, wherein each of said tapered plug sections includes a serrated internal bore defining a knurled semi-tubular surface.

5. A mine roof bolt as set forth in claim 4, wherein the serrations of serrated internal bore are circumferential.

6. A mine roof bolt as set forth in claim 4, wherein the serrations of said serrated internal bore as angular, defining a diamond pattern.

7. A mine roof bolt as set forth in claim 1, wherein said outer surface of said drive collar defines a hexagonal head essentially concentric with said frusto-conical inner surface.

8. A mine roof bolt as set forth in claim 1, wherein said drive collar includes a semi-spherical washer surface on one end thereof.

9. A mine roof bolt comprising:

(a) a length of multi-strand, pre-stressed steel cable defining a bolt shank;

(b) a two-piece tapered plug comprising two essentially diametrically opposed semi-frusto-conical tapered plug sections having an internal bore essentially concentric with the outer surface of said semi-frusto-conical tapered plug sections, said tapered plug being mounted about an end of said cable at said internal bore; and (c) an internally tapered drive collar having a frusto-conical inner surface that engages said frusto-conical outer surfaces of said tapered plug sections, and having an outer surface defining a drive head that accepts a driving mechanism for rotating and linearly translating said bolt, wherein said tapered plug is mounted on an end of said cable, and said drive collar is pressed down upon said tapered plug, forcing said tapered plug against said cable, such that said drive collar, said tapered plug, and said cable, when fitted tightly together, define said mine roof bolt.

10. A mine roof bolt as set forth in claim 9, wherein said outer surface of said drive collar defines a hexagonal head essentially concentric with said frusto-conical inner surface.

11. A mine roof bolt as set forth in claim 9, wherein said drive collar includes a semi-spherical washer surface on one end thereof.

* * * * *